US007561814B2

(12) United States Patent
Kawai et al.

(10) Patent No.: US 7,561,814 B2
(45) Date of Patent: Jul. 14, 2009

(54) IMAGE FORMING APPARATUS

(75) Inventors: Atsushi Kawai, Toyokawa (JP); Tatsutoshi Yamada, Toyokawa (JP); Yoshihiko Yoshizaki, Aichi-ken (JP); Kazuo Okunishi, Okazaki (JP); Hideo Mae, Okazaki (JP); Yoshiaki Takano, Toyohashi (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 342 days.

(21) Appl. No.: 11/374,011

(22) Filed: Mar. 14, 2006

(65) Prior Publication Data

US 2006/0291876 A1 Dec. 28, 2006

(30) Foreign Application Priority Data

Jun. 22, 2005 (JP) ..... 2005-181653

(51) Int. Cl.
*G03G 15/00* (2006.01)

(52) U.S. Cl. ..... 399/12; 399/13; 399/24

(58) Field of Classification Search ..... 399/12, 399/13, 24

See application file for complete search history.

(56) References Cited

U.S. PATENT DOCUMENTS 5,701,402 A 12/1997 Miyamoto et al.
6,144,812 A 11/2000 Ueno
2003/0031475 A1* 2/2003 Asakura ..... 399/12
2005/0244170 A1* 11/2005 Ono et al. ..... 399/12
2006/0193642 A1* 8/2006 Morimoto ..... 399/12

FOREIGN PATENT DOCUMENTS

JP 9-185236 7/1997
JP 11-327367 11/1999

OTHER PUBLICATIONS

Chinese Office Action mailed Jul. 4, 2008 directed towards corresponding foreign application, No. CN200610059694.1; 7 pages.
Japanese Office Action mailed Jul. 15, 2008 directed towards counterpart foreign application No. 2005-181653; 4 pages.

* cited by examiner

*Primary Examiner*—David M Gray
*Assistant Examiner*—Ryan D Walsh
(74) *Attorney, Agent, or Firm*—Morrison & Foerster LLP

(57) ABSTRACT

An image forming apparatus, in which a consumption article can be attached to and detached from a main body, has a device that makes an access to a memory provided on the consumption article, a device that determines whether or not an access failure has occurred during the access to the memory, and a device that switches over between warning levels according to the address of the memory where the access failure has occurred or an attribute concerning write and read where the access failure has occurred.

16 Claims, 4 Drawing Sheets

*Fig. 2*

| ADDRESS | KINDS OF STORAGE DATA | MEMORY ATTRIBUTE | WARNING LEVEL DURING ACCESS FAILURE |
|---|---|---|---|
| 00h<br>~<br>1Fh | MODEL IDENTIFICATION CODE<br>COLOR IDENTIFICATION CODE<br>LOADING WEIGHT IDENTIFICATION CODE | ONLY READABLE | TROUBLE LEVEL<br>(WARNING DISPLAY, PRINTING INHIBITED) |
| 20h<br>~<br>2Fh | USE HISTORY DATA | ONCE WRITABLE | INTERNAL LEVEL<br>(NO DISPLAY, PRINTABLE) |
| 30h<br>~<br>3Fh | PRINTING OPERATION STATUS | READABLE/WRITABLE | CAUTION LEVEL<br>(CAUTION DISPLAY, PRINTABLE) |

IMAGE FORMING APPARATUS

RELATED APPLICATION

This application is based on Japanese Patent Application No. 2005-181653, the content of which is incorporated herein by reference.

BACKGROUND OF THE INVENTION

The present invention relates to an image forming apparatus.

In an image forming apparatus, it is general to provide each of consumption articles such as a toner cartridge and an image forming unit with a memory that stores adjustment information, use history and the like of the consumption article. The image forming apparatus is controlled to carry out optimal image forming operation by reading information from the memories of the consumption articles and putting the variations and so on of the consumption articles into consideration.

The image forming apparatus disclosed in U.S. Pat. No. 5,701,402 updates the information of the memory provided on the main body at any time so that the information coincides with the information of the memories of the consumption articles, and inhibits the image forming operation when the information read from the memories of the consumption articles does not coincide with the information stored in the memory of the main body.

The memories of the consumption articles sometimes cause an access failure because of defective electrical contact or the like. The image forming apparatus of U.S. Pat. No. 5,701,402 has had a problem that, when an access failure to the memory of a consumption article occurs, the image forming operation has been indiscriminately inhibited and the user has been required to carry out troubleshooting.

SUMMARY OF THE INVENTION

An object of the present invention is to provide an image forming apparatus in which a downtime for troubleshooting due to an access failure to the memory is reduced in view of the problem.

In order to achieve the object, the image forming apparatus of a first aspect of the present invention is an image forming apparatus in which a consumption article can be attached to and detached from a main body, the apparatus comprising:

a device that makes an access to a memory provided on the consumption article;

a device that determines whether or not an access failure has occurred during the access to the memory; and a device that switches over between warning levels according to an address of the memory where the access failure has occurred.

According to the construction, when an access to information such that the device operation is not hindered even if the contents are not known out of the information stored in the memory of the consumption article, the image forming apparatus can be operated without inhibiting the image forming operation of the image forming apparatus. With this arrangement, the trouble stop due to the access failure to the memory can be reduced, the load on the user is reduced and the downtime of the apparatus is shortened.

The image forming apparatus of a second aspect of the present invention is an image forming apparatus in which a consumption article can be attached to and detached from a main body, the apparatus comprising:

a device that makes an access to a memory provided on the consumption article;

a device that determines whether or not an access failure has occurred during the access to the memory; and a device that switches over between warning levels according to an attribute concerning write and read of the memory where the access failure has occurred.

According to the construction, the information important for the operation of the image forming apparatus is normally stored into a memory that is not rewritable but only readable. Therefore, if the attribute of the memory where the access failure has occurred is writable, the information is not important information that leads to the damage of the image forming apparatus. Therefore, if the image forming operation is inhibited only when the attribute of the memory where the access failure has occurred is only readable, the stop time of the image forming apparatus can be reduced.

Moreover, in the image forming apparatuses of the first and second aspects of the present invention, the warning levels may include at least three levels of a level at which no warning is displayed and image forming is not inhibited, a level at which a warning is displayed but image forming is permitted and a level at which a warning is displayed and image forming is inhibited. If there are the three levels as the warning levels, it is possible to choose the management level according to the importance of the information in a manner that the image forming operation is inhibited only when a failure in obtaining the information might cause a trouble of the image forming apparatus, only the warning is issued to the user without inhibiting the image forming operation when the failure in obtaining the information might not cause a trouble but influence the quality of the image and the user is not required to carry out the processing merely with internal recognition achieved when the control suffers no influence even without information.

Moreover, in the image forming apparatuses of the first and second aspects of the present invention, the consumption article should properly include any one or a plurality of an image forming unit, a toner cartridge, a transfer unit and a fixing unit. By ranking the warning levels while optimizing the image forming operation with a memory provided on each of principal consumption articles, the downtime of the apparatus can be suppressed to the minimum even if an access failure occurs, and the load on the user can also be suppressed to the minimum.

Moreover, the control method of the present invention is a control method to be executed in an image forming apparatus in which a consumption article can be attached to and detached from a main body, the method comprising the steps of:

making an access to a memory provided on the consumption article;

determining whether or not an access failure has occurred during the access to the memory; and switching over between warning levels according to the address of the memory where the access failure has occurred or an attribute concerning write and read of the memory where the access failure has occurred.

As described above, according to the present invention, an image forming apparatus, which provides appropriate information for the user while suppressing the downtime to the minimum and reduces the load on the user for troubleshooting by changing the warning level depending on the address or the attribute of the memory even if the access failure to any memory of the consumption articles occurs, can be provided.

BRIEF DESCRIPTION OF THE DRAWINGS

The present invention will be further described with reference to the accompanying drawings wherein like reference numerals refer to like parts in the several views, and wherein:

FIG. 2 is a table showing the addresses of a toner cartridge memory in FIG. 1 and the warning levels at the time of access failure;

DETAILED DESCRIPTION OF THE PREFERRED EMBODIMENTS

Figure 1:
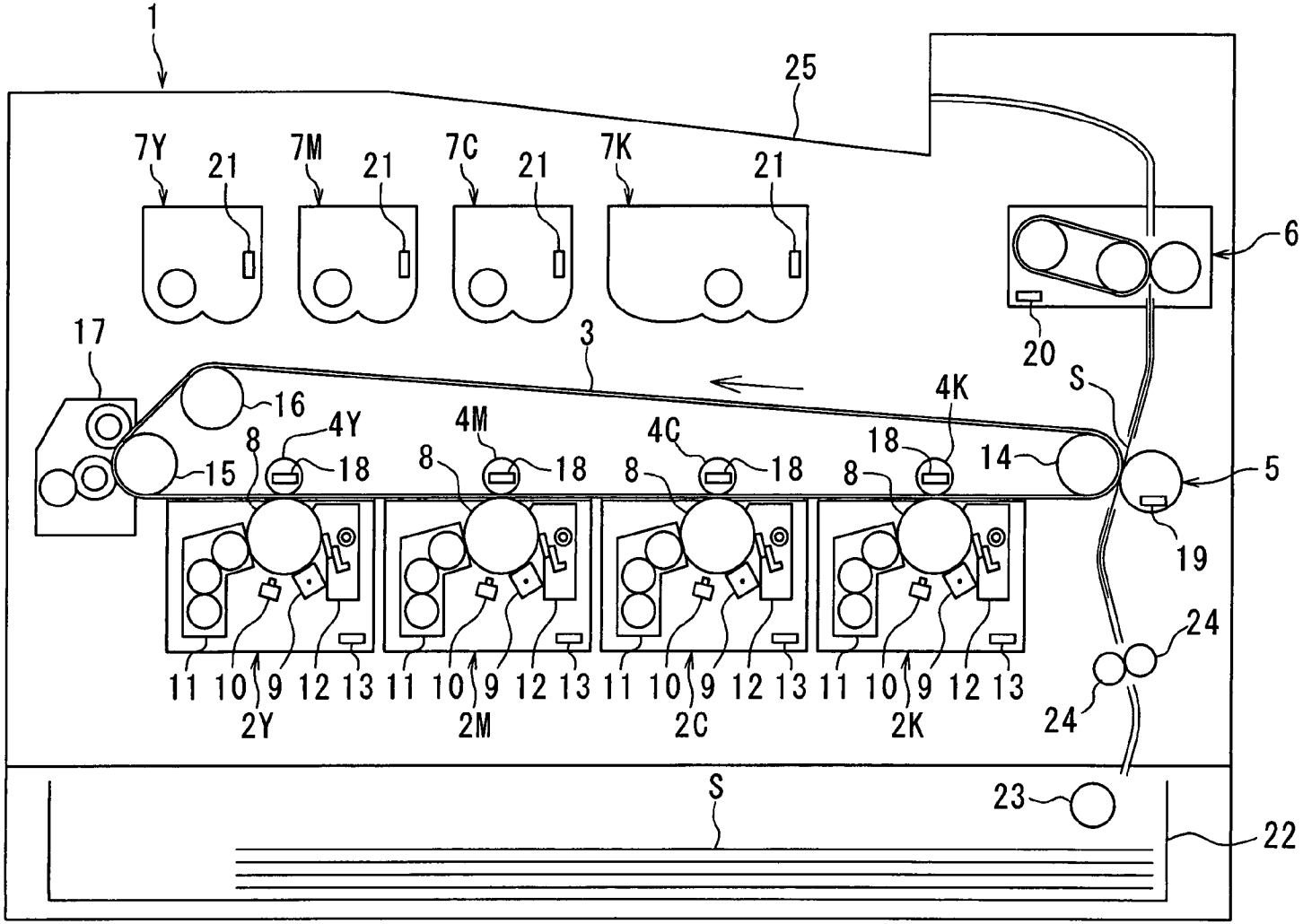
FIG. 1 is a schematic diagram showing the construction of an image forming apparatus according to a first embodiment of the present invention.

FIG. 1 shows an image forming apparatus according to one embodiment of the present invention. The image forming apparatus has in its main body 1 four image forming units (consumption articles) 2Y, 2M, 2C and 2K that form yellow, magenta, cyan and black toner images, a transfer belt 3, primary transfer units (consumption articles) 4Y, 4M, 4C and 4K that transfer toner images formed by the image forming units 2Y, 2M, 2C and 2K onto the transfer belt 3 by electrostatic forces, a secondary transfer unit (consumption article) 5 that transfers the toner image transferred on the transfer belt 3 onto a recording paper S by electrostatic forces, a fixing unit (consumption article) 6 that fixes the toner image on the recording paper S by heating, and toner cartridges (consumption articles) 7Y, 7M, 7C and 7K that supply yellow, magenta, cyan and black toners to the image forming units 2Y, 2M, 2C and 2K, respectively.

Each of the image forming units 2Y, 2M, 2C and 2K has a rotary drum-shaped photoreceptor 8, a charger 9 that electrically charges the photoreceptor 8, an exposure unit 10 that forms an electrostatic latent image by exposing the charged photoreceptor 8 to light, a developer 11 that makes a toner adhere to the electrostatic latent image, a cleaner 12 that scrapes the toner off the surface of the photoreceptor 8, and an image forming unit memory 13 that stores the information of the characteristics, use history(or log), adjustment values of a ratio of toner to carrier and the operation conditions and so on. Although the one that includes the photoreceptor 8 and the developer 11 has been illustrated as the image forming unit 2 in the present embodiment, the image forming unit may be one that includes only the photoreceptor 8 or one that includes only the developer 11.

The transfer belt 3 is wound around a driving roller 14 to be driven, a free roller 15 and a tension roller 16 that applies a tension force and rotates in the direction of the arrow by the driving roller 14. The image forming apparatus is further provided with a cleaner unit 17 that removes the toner remaining on the surface of the transfer belt 3.

Each of the primary transfer units 4Y, 4M, 4C and 4K has a primary transfer unit memory 18 that stores the information of the adjustment value, use history and so on. The secondary transfer unit 5 has a secondary transfer unit memory 19. The fixing unit 6 has a fixing unit memory 20. Each of the toner cartridges 7Y, 7M, 7C and 7K has a toner cartridge memory 21 that stores the information of use history of the number used print sheets and so on.

The recording papers S are supplied to a paper feeding part 22, fed one after another by a feed roller 23, conveyed to the secondary transfer unit 5 by a conveyance roller 24 and discharged through the fixing unit 6 to a sheet discharge part 25 at the upper portion of the main body 1.

The image forming apparatus has a device to make accesses to the image forming unit memory 13, the primary transfer unit memory 18, the secondary transfer unit memory 19, the fixing unit memory 20 and the toner cartridge memory 21 and reads information from each memory during the image forming operation. Moreover, the image forming apparatus has a device to determine whether an access failure has occurred when a failure has occurred in making an access to the image forming unit memory 13, the primary transfer unit memory 18, the secondary transfer unit memory 19, the fixing unit memories 18, 19, 20 and 21 and the toner cartridge memory 21.

When the device detects the access failure to the memory, different kinds of warning are issued in the image forming apparatus. As an example, the processing when a failure has occurred in making an access to the toner cartridge memory 21 of the toner cartridge 7K in the image forming apparatus of the present embodiment is described below.

FIG. 2 is a table showing the kind of information stored in the toner cartridge memory 21 of the toner cartridge 7K, the attribute of the memory and the warning level at the time of an access failure. The toner cartridge memory 21 has addresses 00h through 3Fh and is constructed of three kinds of storage elements of different attributes.

The addresses 00h through 1Fh are written in a manufacturing stage and are constructed of a read-only memory (ROM) that is not writable but only readable by the image forming apparatus. The addresses 20h through 2Fh are constructed of a one-time programmable memory (OTP-ROM) that is once writable by the image forming apparatus. The addresses 30h through 3Fh are constructed of a memory (R/W memory) such as a RAM that is freely rewritable by the image forming apparatus.

Moreover, the addresses 00h through 1Fh store a model identification code that represents the type of the toner cartridge 7K, a color identification code that represents the color of the loaded toner, a loading weight identification code that represents the amount of the loaded toner and so on. In the addresses 20h through 2Fh are written use history data that represents whether or not the toner cartridge 7K is a new article, how much the toner has been consumed and so on. In the addresses 30h through 3Fh are written temporary information during the printing (image forming) such as the number of revolutions of the toner feed screw and so on.

Figure 3:
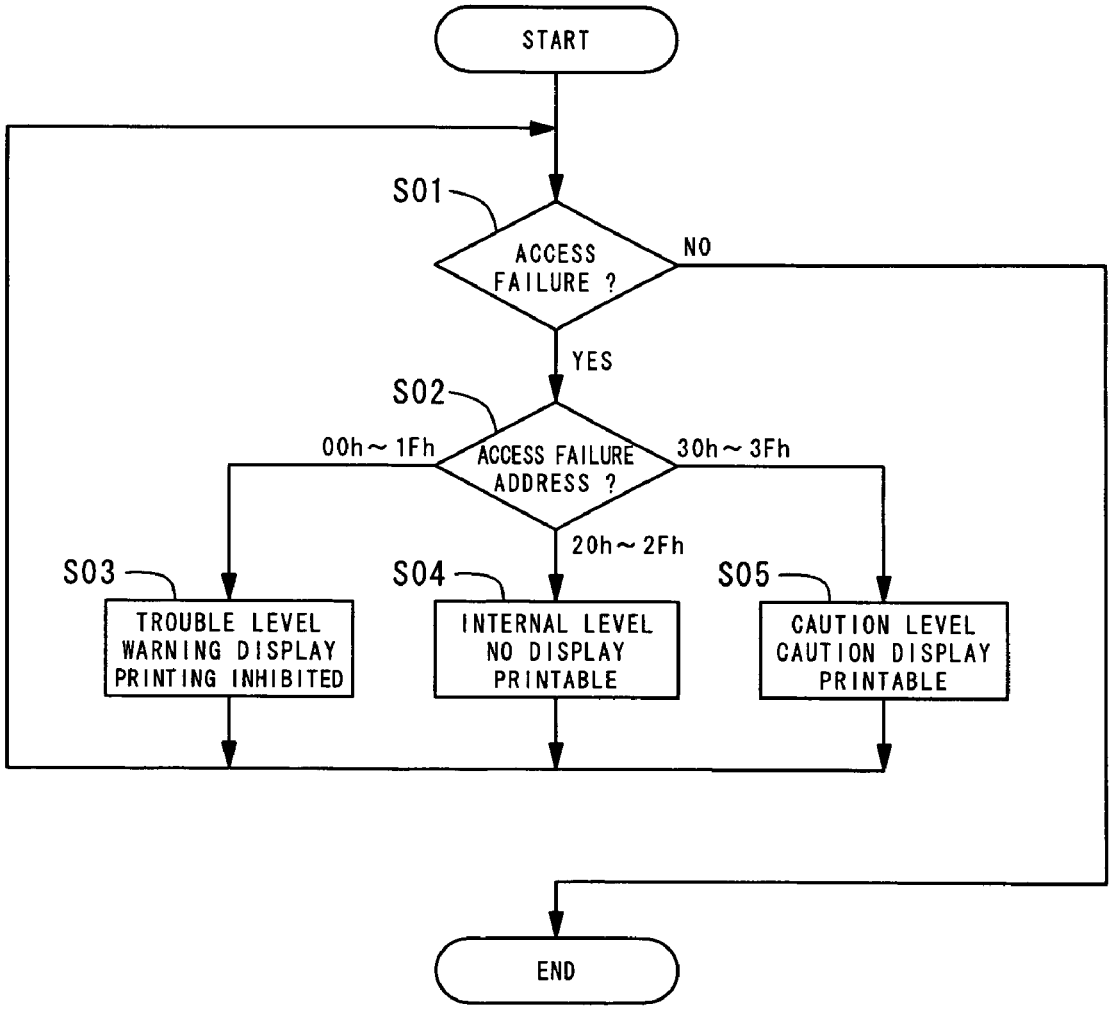
FIG. 3 is a flowchart of an access failure detecting process in the image forming apparatus of FIG. 1.

FIG. 3 shows the processing when any of the areas of the toner cartridge memory 21 has not been normally accessible. The image forming apparatus of the present embodiment confirms the address of the toner cartridge memory 21 where the access failure has occurred in step S02 upon determining that the access failure has occurred in step S01. When the address where the access failure has occurred is any one of 00h to 1Fh, the warning level is set to a trouble level, a display or an alarm for informing the user of the trouble is issued, and the printing operation is inhibited until a normal access can be made by stopping the printing operation in step S03. When the address where the access failure has occurred is any one of 20h to 2Fh, the warning level is set to an internal level at which the access failure is merely recognized in the image forming apparatus, and neither notification to the user nor the stopping of the printing operation is carried out in step S04. When the address where the access failure has occurred is any one of 30h to 3Fh, the warning level is set to a caution level, and the printing operation is not inhibited although a caution for informing the user of the access failure is displayed in step SO5.

The reason why the warning level is different at the time of the access failure as described above is described. As shown in FIG. 2, the model identification code, the color identification code, the loading weight identification code and so on stored in the addresses 00h through 1Fh of the toner cartridge memory 21 are the information peculiar to the toner cartridge 7K indispensable for the printing operation of the image forming apparatus. Assuming that a toner cartridge, which does not correspond to the image forming apparatus, is mounted by mistake, not only the normal printing cannot be guaranteed but also it is concerned that the image forming apparatus suffers a mechanical damage. Moreover, if the color identification code cannot be confirmed, it cannot be known whether the printing can be achieved in the correct color. As described above, in the case where the image forming apparatus cannot correctly make an access to the specified address of the toner cartridge memory 21 (and the memories 13, 18, 19 and 20 of the other consumption articles) that store the information necessary for carrying out the correct printing operation, the case is treated at the trouble level at which the printing operation is inhibited and a warning for requiring the user to carry out troubleshooting is issued.

The use history data stored in the addresses 20h through 2Fh of the toner cartridge memory 21 is used as a criteria regarding whether or not the toner cartridge 7K can be recycled and is not the information used for the printing operation by the image forming apparatus. If the addresses 20h through 2Fh that store the information are not normally accessible, it is considered that the operation of the requested printing is not hindered and no damage of the image forming apparatus is caused. Therefore, in the case where the specified address that stores the information unnecessary for the printing is not correctly accessible, the image forming apparatus treats the case at the internal level at which mere recognition is made in the image forming apparatus.

A printing operation status stored in the addresses 30h through 3Fh of the toner cartridge memory 21 is to temporarily store, for example, the number of revolutions of the toner feed screw during the printing operation and is used for estimating the residual amount of the toner by integrating the number of revolutions of the toner feed screw. If the printing operation is repeated while such information cannot be confirmed, the timing of detecting the shortage of the remaining toner and notifying the user of the information becomes inaccurate, which is undesirable. However, the fact that such information cannot be obtained does not directly hinder the required printing operation at each occasion, and it is sufficient for the user to carry out the processing at his or her disengaged time without interrupting the flow of the work. Therefore, in the case where a correct access cannot be made to a specified address storing the information that is not directly needed for the printing but required to maintain the printing state for a long time, the image forming apparatus treats the case at the caution level at which a display for urging the user to deal with the case is displayed but the printing operation can be continuously carried out.

The determination of the access failure and the management at the time of the access failure at the toner cartridge memory 21 of the toner cartridge 7K as described above are similarly carried out for the cartridges 7Y, 7M and 7C of the other colors. With regard to the memories (image forming unit memory 13, primary transfer unit memory 18, secondary transfer unit memory 19 and fixing unit memory 20) of the other consumption articles, the warning level at the time of access failure is set to any one of the trouble level, the caution level and the internal level at each address and subjected to the determining process.

As described above, the image forming apparatus of the present embodiment does not indiscriminately inhibit the printing even when an access failure occurs in the toner cartridge memory 21 or the memories (13, 18, 19, 20) of the other consumption articles. By carrying out the processing at the warning level at which the printing is not inhibited depending on the address of the memories 13, 18, 19, 20 or 21 where the access failure has occurred, the downtime of the image forming apparatus and the load on the user are reduced, and the convenience can be improved.

The toner cartridge memory 21 and the memories 13, 18, 19 and 20 of the other consumption articles are each constructed as a set of three kinds of memories of different attributes like the ROM, OTP-ROM or R/W memory as described above. Therefore, it is often the case where access failures concurrently occur in a plurality of areas of the same attribute. On the other hand, the information stored in the toner cartridge memory 21 is determined as to which attribute the information is stored with depending on the characteristics thereof. For example, it is risky that information necessary for carrying out the correct printing operation is rewritten into erroneous information, and therefore, the information is stored into a ROM that is only readable. Moreover, information like the use history that is less important for the printing operation is stored into an OTP-ROM (one-time programmable memory) of a type less expensive than the R/W memory, and information that does not give mechanical damages to the image forming apparatus even when not obtained but is profitable for image forming is stored into a memory area that is both readable and writable.

Therefore, as shown in FIG. 2, it is often the case where the pieces of information stored in the areas of the same attribute of the memory are at the same warning level when the information is inaccessible. Accordingly, the number of times of confirming the warning level can be reduced by not setting the management at the time of access failure for each address but setting the management for each attribute of the memory.

Figure 4:
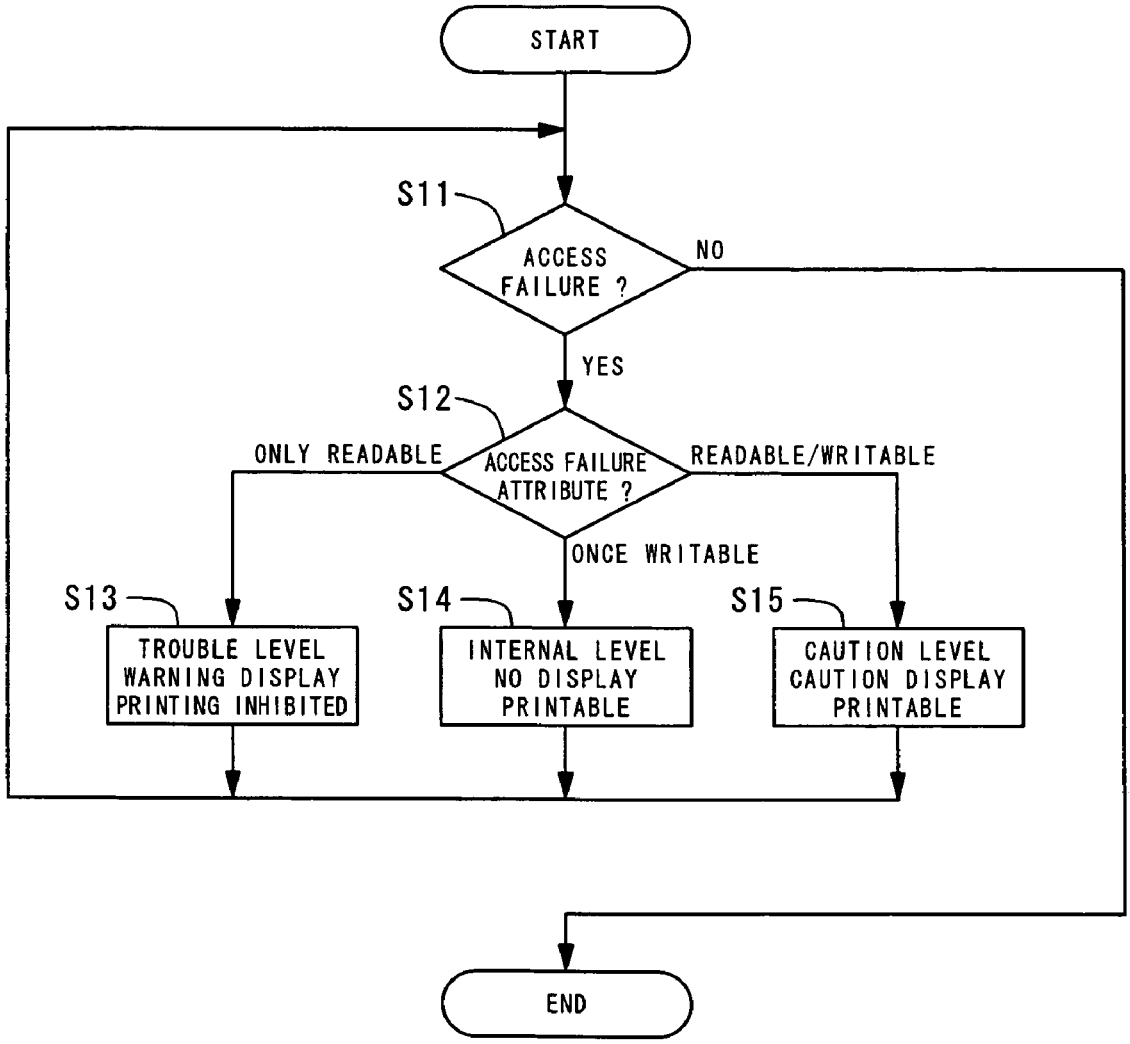
FIG. 4 is a flowchart of the access failure detecting process in an image forming apparatus as an alternative of FIG. 3.

FIG. 4 shows an alternative proposal of the processing when any area of the toner cartridge memory 21 of FIG. 3 has not been inaccessible. During the processing, when it is determined that an access failure has occurred in step S11, the attribute concerning the read and write in the area of the toner cartridge memory 21 where the access failure has occurred is confirmed in step S12. If the attribute of the area where the access failure has occurred is only readable, the warning level is set to the trouble level in step S13, a display or an alarm for informing the user of the trouble is issued, and the printing operation is inhibited. If the attribute of the area where the access failure has occurred is only once writable, the warning level is set to the internal level in step S14. If the attribute of the area where the access failure has occurred is both readable and writable, the warning level is set to the caution level in step S15, and a caution is displayed for the user but the printing operation is not inhibited.

The present invention may also be applied to a memory provided for any constituent element (not shown). The memory is not limited to the semiconductor memory but allowed to be magnetic, mechanical or any other storage elements. Moreover, the control may be executed by software processing (processing executed by a CPU according to a given program) or executed by a hardware circuit. Further, the warning levels are not limited to the three kinds of levels of the "trouble level", the "internal level" and the "caution level" but allowed to be two kinds or four or more kinds of levels. Moreover, the operation of the display and so on executed in correspondence with each warning level is not limited to those illustrated in the embodiment.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus in which a consumption article can be attached to and detached from a main body, the apparatus comprising:

a memory-access unit configured to access to a memory provided on the consumption article;

a determination unit configured to determine whether or not an access failure has occurred during the access to the memory; and a switching unit configured to switch over between a plurality of warning levels according to an address of the memory where the access failure has occurred.

2. The image forming apparatus as claimed in claim 1, wherein the warning levels include at least a level at which no warning is displayed and image forming is not inhibited, a level at which a warning is displayed but image forming is permitted and a level at which a warning is displayed and image forming is inhibited.

3. The image forming apparatus as claimed in claim 1, wherein the consumption article includes an image forming unit.

4. The image forming apparatus as claimed in claim 1, wherein the consumption article includes a toner cartridge.

5. The image forming apparatus as claimed in claim 1, wherein the consumption article includes a transfer unit.

6. The image forming apparatus as claimed in claim 1, wherein the consumption article includes a fixing unit.

7. An image forming apparatus in which a consumption article can be attached to and detached from a main body, the apparatus comprising:

a memory-access unit configured to access to a memory provided on the consumption article, the memory having a plurality of memory attributes relating to at least one of readability or writability of memory addresses;

a determination unit configured to determine that determines whether or not an access failure has occurred during the access to the memory; and a switching unit configured to switch over between a plurality of warning levels according to a memory attribute from the plurality of memory attributes of the memory address where the access failure has occurred.

8. The image forming apparatus as claimed in claim 7, wherein the warning levels include at least a level at which no warning is displayed and image forming is not inhibited, a level at which a warning is displayed but image forming is permitted and a level at which a warning is displayed and image forming is inhibited.

9. The image forming apparatus as claimed in claim 7, wherein the consumption article includes an image forming unit.

10. The image forming apparatus as claimed in claim 7, wherein the consumption article includes a toner cartridge.

11. The image forming apparatus as claimed in claim 7, wherein the consumption article includes a transfer unit.

12. The image forming apparatus as claimed in claim 7, wherein the consumption article includes a fixing unit.

13. A control method to be executed in an image forming apparatus in which a consumption article can be attached to and detached from a main body, the method comprising the steps of:

making an access to a memory provided on the consumption article;

determining whether or not an access failure has occurred during the access to the memory; and switching over between a plurality of warning levels according to an address of the memory where the access failure has occurred.

14. The control method as claimed in claim 13, wherein the warning levels include at least a level at which no warning is displayed and image forming is not inhibited, a level at which a warning is displayed but image forming is permitted and a level at which a warning is displayed and image forming is inhibited.

15. A control method to be executed in an image forming apparatus in which a consumption article can be attached to and detached from a main body, the method comprising the steps of:

making an access to a memory provided on the consumption article, the memory having a plurality of memory attributes relating to at least one of readability or writability of memory addresses;

determining whether or not an access failure has occurred during the access to the memory; and switching over between a plurality of warning levels according to a memory attribute from the plurality of memory attributes of the memory address where the access failure has occurred.

16. The control method as claimed in claim 15, wherein the warning levels include at least a level at which no warning is displayed and image forming is not inhibited, a level at which a warning is displayed but image forming is permitted and a level at which a warning is displayed and image forming is inhibited.

* * * * *